US005915681A

United States Patent [19]

Milne

[11] Patent Number: 5,915,681

[45] Date of Patent: Jun. 29, 1999

[54] SHEET HANDLING APPARATUS

[75] Inventor: Douglas L. Milne, Dundee, United Kingdom

[73] Assignee: NCR Corporation, Dayton, Ohio

[21] Appl. No.: 08/883,474

[22] Filed: Jun. 25, 1997

[30] Foreign Application Priority Data

Nov. 8, 1996 [GB] United Kingdom ..... 9623289

[51] Int. Cl.[6] ..... B65H 5/00

[52] U.S. Cl. ..... 271/12; 271/270; 271/275; 271/202; 198/577; 198/460.1; 198/461.3

[58] Field of Search ..... 271/10.02, 10.04, 271/10.07, 12, 202, 270, 275; 198/577, 460.1, 461.3

[56] References Cited

U.S. PATENT DOCUMENTS

| | | | |
|---|---|---|---|
| 4,518,158 | 5/1985 | Goi | 271/12 X |
| 4,653,630 | 3/1987 | Bravin | 198/577 X |
| 5,037,365 | 8/1991 | Breton | 271/202 X |

FOREIGN PATENT DOCUMENTS 0486251 5/1992 European Pat. Off. .

*Primary Examiner*—Boris Milef

[57] ABSTRACT

Sheet handling apparatus, and more particularly a cash dispenser unit, has a number of cassettes (1,2) which hold currency notes. Pick mechanisms (3,4) are associated with each cassette and function to transfer notes from the cassettes to conveyor belts for passage to an outlet point. There are two successive conveyor belt systems. The first belt is driven by an induction motor (7) which also provides power for the pick mechanisms. The second belt system (9,19) is driven by a stepper motor (12). The stepper motor is required to operate under two different control regimes. In one it is synchronized to the speed of the induction motor (7) and for this purpose the induction motor (7) has an optical timing disc 27 mounted on its shaft (21) which cooperates with an optical sensor (28) to generate a pulse train to drive the stepper motor (12) through a selector (25) and driver circuit (23). For the other control regime a pulse generator (26) supplies pulses through the selector (25) to the stepper motor (12). The selector (25) determines under which control regime the stepper motor (12) operates.

10 Claims, 2 Drawing Sheets

SHEET HANDLING APPARATUS

BACKGROUND OF THE INVENTION

This invention relates to sheet handling apparatus for picking sheets from one or more stacks of sheets and presenting the picked sheets to an outlet point.

The invention has application in cash dispenser units provided as part of automatic teller machines (ATMs). Such units dispense currency notes and include one or more cassette holders for cassettes each containing a stack of currency notes of a particular denomination, usually with different cassettes containing notes of different denominations. Pick mechanisms are associated with each cassette holder to pick notes from the stacks in the cassettes. The notes are then carried by suitable transport means to an outlet point for removal by the customer.

The pick mechanisms may include suction pads for picking the notes one by one from the cassettes and the suction pads are made operational by connection to a vacuum pump. An example of a pick mechanism is described in European Patent Application No. 486251A. A suitably powerful electric motor is required to operate the pump as well as to provide motive power to sheet transport means to carry the notes away from the pick mechanisms. It is also desirable to be able to accurately position the notes when they approach the outlet point. This requirement would be satisfied by using a stepper motor to drive the transport means. However using a stepper motor as the sole source of motive power for the entire apparatus would require a large and hence expensive motor and associated pulse generator. If instead a conventional (and cheaper) ac induction motor is used to operate the vacuum pump and drive the initial part of the sheet transport and the function of the stepper motor is limited to drive the final part of the transport, then problems will occur at the point at which the notes cross over from one drive to the other. If the initial transport is running more slowly than the final transport then the notes are at risk of being ripped, particularly if they already have a small tear. Conversely if the initial transport is running faster than the final transport then the notes are liable to crumple and cause a jam. With a conventional ac induction motor the speed tolerance may be as much as ±20% depending on load.

SUMMARY OF THE INVENTION

It is an object of the invention to ensure that the various parts of a sheet handling apparatus are synchronized with each other in a cost-effective manner.

According to the invention sheet handling apparatus for picking sheets one by one from one or more stacks of sheets and presenting the picked sheets to an outlet point comprises pick means associated with each stack for picking sheets from the stacks, pick transport means for carrying sheets away from the pick means, a first motor for operating the pick means and the pick transport means, presenter transport means for transporting sheets from the pick transport means to the outlet point, a second motor for driving the presenter transport means, the second motor comprising a stepper motor, a pulse generator associated with the stepper motor to supply pulses thereto at a rate which determines its speed of operation, a further pulse generator coupled to the first motor to generate pulses at a rate proportional to the speed of rotation thereof, and selector means for selecting the output of either the pulse generator or the further pulse generator to control the stepper motor so that the speed of the stepper motor can be synchronized with the speed of the first motor by operation of the selector means despite speed fluctuations of the first motor.

In embodiments of the invention the further pulse generator may comprise an optical disc coupled to rotate with the first motor and an optical sensor positioned close to the disc to generate pulses as the disc rotates.

Preferably sheet holding means is provided for temporarily holding in a stack the sheets that pass along the presenter transport, and means for returning the stack of sheets in the holding means back to the presenter means for transfer to the outlet point.

The pick transport means and the presenter transport means preferably each include respective conveyor belts for carrying sheets picked from the stacks, the belts being separated from each other by a gap narrow enough to allow picked sheets to pass from one belt to the next.

BRIEF DESCRIPTION OF THE DRAWINGS

In order that the invention may be more fully understood reference will now be made to the accompanying drawings in which.

DETAILED DESCRIPTION

Figure 1:
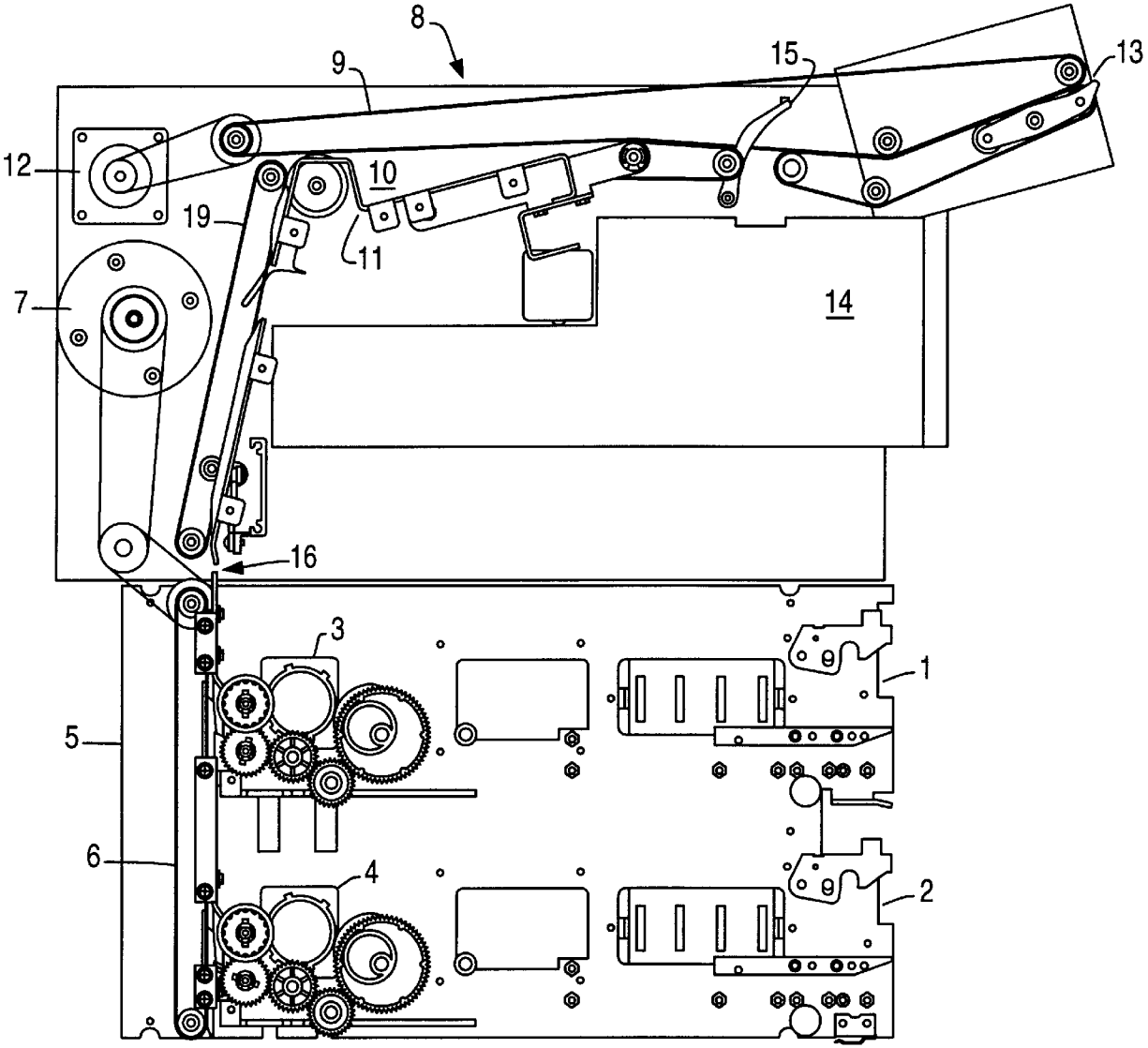
FIG. 1 is a side view of apparatus embodying the invention.

Referring now to FIG. 1 there is shown therein sheet handling apparatus and more specifically a cash dispenser unit which forms part of an ATM. As illustrated the unit includes two cassettes 1 and 2 each designed to hold a stack of sheets which in the case of a cash dispenser unit will comprise currency notes. It is likely, but not essential, that the two cassettes will hold notes of different sizes and denominations. Also while two cassettes are illustrated a greater or lesser number can be provided as required.

Associated with each cassette are respective pick mechanisms 3 and 4. An example of a suitable pick mechanism is described in European Patent Application No. 486251A, the text of which is incorporated herein by reference. As described in more detail in the reference the pick mechanisms include moveable suction pads which function to lift sheets one by one from the stacks in the cassettes 1 and 2. Pick transport means 5, which includes a conveyor belt 6, is provided to convey picked notes away from the pick mechanisms 3 and 4. For this purpose the respective pick mechanisms 3 and 4 operate to place the picked notes onto conveyer belt 6. Power to operate the pick transport means 5 and a vacuum pump (not shown) for the suction pads is provided by an ac induction motor 7. The vacuum pump is coupled by vacuum lines to the suction pads which form part of pick mechanisms 3 and 4.

In addition to the features described above the apparatus also includes a presenter transport means 8 the function of which is to carry the picked sheets to an outlet point for removal by the customer. Presenter transport means 8 includes linked conveyer belts 9,19 and a stack area 10 having a base plate 11. Base plate 11 is hinged and initially is positioned away from and below the lower surface of conveyor belt 9 in a manner such that sheets which pass along the lower surface of belt 9 drop onto plate 11 and are held in stack area 10. After all the notes are collected in stack area 10 base plate 11 is swung up to cause the notes to engage with conveyor belt 9 of presenter transport 8.

At this stage it is desirable to provide accurate positional control over the currency notes. For this purpose a stepper motor 12 is provided to act as the motive power source for presenter transport 8. The notes can then be conveyed under the control of stepper motor 12 to an outlet point 13 where they are available for removal by a customer.

Between stack area 10 and outlet point 13 it is useful to provide a purge bin 14 into which the notes can be dropped if the operation is aborted. A rocker gate 15 is provided for this purpose in the path of the notes between stack area 10 and outlet point 13. As the notes move forward along conveyor belt 9 they deflect rocker gate 15 and have unimpeded passage to outlet point 13. If the notes need to be retracted so as not to reach the customer then stepper motor 12 is reversed to reverse the direction of travel of belt 9 and rocker gate 15 remains in its undeflected position to divert the notes into purge bin 14 from which they can be recovered.

Since the notes must pass from conveyor belt 6 to conveyor belt 19 the belts need to be separated from each other by a gap 16 narrow enough to allow picked notes to pass from belt 6 to belt 19. For the transfer operation across gap 16 to be successful the two belts need to run at the same speed as each other, or at least at very closely related speeds. If belt 6 runs too slowly in relation to belt 19 then notes are at risk of being ripped as they cross gap 16, particularly if they already have a small tear as used notes sometimes do. Conversely if belt 6 is running faster than belt 19 then the notes are liable to crumple as they cross gap 16 and cause a jam. However belt 6 is driven by induction motor 7 while belt 19 is driven by stepper motor 12 for reasons explained above. The speed of operation of an induction motor can vary by as much as ±20% depending on load. The load can increase considerably with a very fully stacked cassette of notes. If alternatively both transports 5 and 8 were to be driven from a single motor it would have to be a stepper motor and the cost of a sufficiently high power stepper motor would be high. Instead, it is more cost effective to synchronize the speed of operation of stepper motor 12 to that of induction motor 7 despite speed fluctuations of motor 7. Synchronization is achieved by the arrangement shown in FIG. 2.

Figure 2:
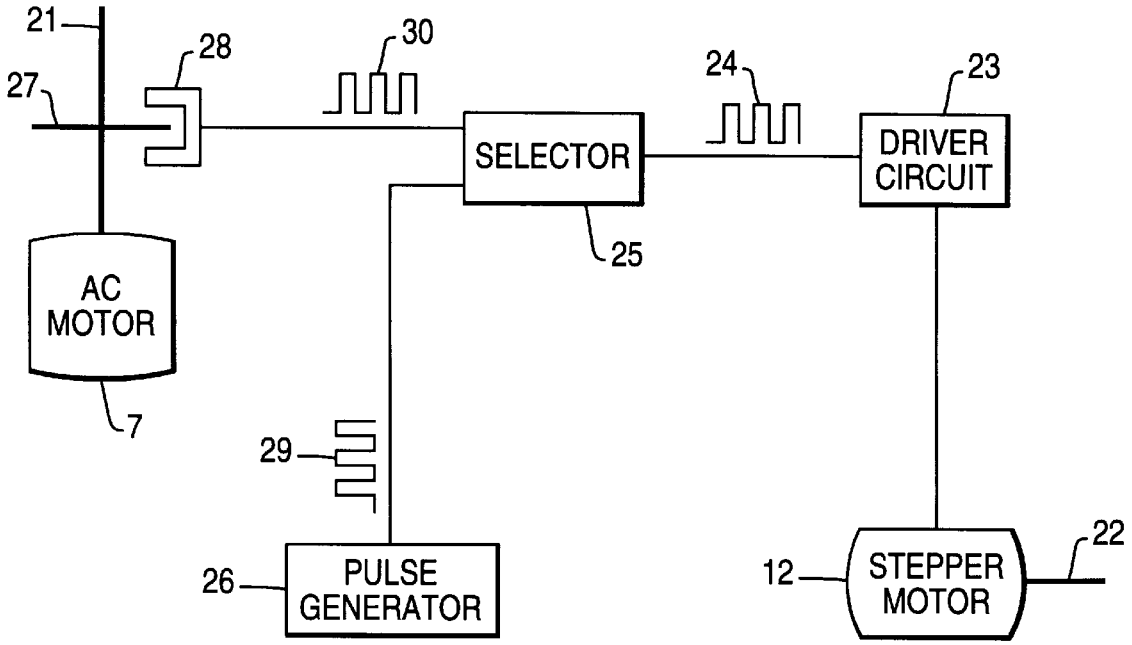
FIG. 2 is a diagrammatic view of the two motors and the control gear for the stepper motor.

Referring now to FIG. 2 there is shown therein in diagrammatic form ac induction motor 7 and its drive shaft 21. The vacuum pump and pick transport means 5 (FIG. 1) are both driven from shaft 21, the latter through suitably sized pulley wheels and drive belts (FIG. 1). Stepper motor 12 has a shaft 22 from which presenter transport means 8 is driven, again through suitably sized pulleys and belts. Motor 7 is, for example, a conventional ac induction motor powered from a mains supply. Stepper motor 12 is powered by a stepper motor driver circuit 23 which supplies a train of power pulses to motor 12. Each pulse from circuit 23 causes motor 12 to step round by a predetermined angle. An input pulse train 24 to driver circuit 23 determines the format of the power pulse train supplied to motor 12. Pulse train 24 can be generated by either of two sources. Which of the two sources is selected is determined by a selector 25. Selector 25 has two inputs, one from each source. One of the inputs is from a pulse generator 26 which generates a pulse train 29. The other input is from a further pulse generator comprising an optical timing disc 27 mounted on the drive shaft 21 of motor 7 to rotate therewith and a fixed optical sensor 28 positioned close to disc 27.

Optical timing disc 27 has alternate opaque and transparent sectors positioned evenly round its circumference. Optical sensor 28 comprises a radiation source and detector. The radiation source is positioned to direct a beam of radiation onto disc 27 so that the beam will be transmitted through the transparent sectors of disc 27 and blocked by the opaque sectors as they intercept the beam. The detector is positioned to receive the beam which is transmitted through disc 27. The output of the detector and thus of sensor 28 will be a train of pulses 30 which is generated at a rate proportional to the speed of rotation of motor 7. The pulse train 30 from sensor 28 is used as the other input to selector 25. If necessary the output from sensor 28 can be passed through a logic gate with hysteresis to eliminate noise before being fed to selector 25.

In operation of the apparatus described in FIGS. 1 and 2 both motors are energized when a validated request for currency notes by a customer is received and selector 25 is operated so that driver circuit 23 receives input pulse train 30 from sensor 28. The speed of rotation of stepper motor 12 is therefore proportional to the speed of induction motor 7 irrespective of the speed of the latter and despite any speed fluctuations. Conveyor belt 6 and conveyor belt 19 will therefore move at identical speeds, or at closely similar speeds as determined by the number of sectors in timing disc 27. Thus any sheets or currency notes held in cassettes 1 or 2 that are picked up by respective pick mechanisms 3 and 4 and placed on conveyor belt 6 pass safely across the gap 16 between the belts and travel along belt 19 and the underside of belt 9 to stack area 10. When all the notes are collected in stack area 10 selector 25 is operated to pass input pulse train 29 from pulse generator 26 to driver circuit 23. At this time hinged base plate 11 is raised to present the stack of notes held in stack area 10 to presenter drive belt 9. At this stage any movement of the notes is controlled solely by pulse train 29. The accurate positioning of the notes in their passage to outlet point 13 can therefore be ensured. Also if necessary motor 12 can reverse belt 9 to divert notes to purge bin 14.

In practice it may be desirable to drive belts 9 and 19 at a slightly higher speed than belt 6, say 1% or 2% faster. The exact speed difference (if any) is determined by the number of sectors in disc 27.

What is claimed is:

1. An apparatus for picking sheets one by one from one or more stacks of sheets and presenting the picked sheets to an outlet point, the apparatus comprising:

a picker mechanism associated with each stack for picking sheets from the stacks;

a pick transport mechanism for carrying sheets away from the picker mechanism;

a first motor for operating the picker mechanism and the pick transport mechanism;

a presenter transport mechanism for transporting sheets from the pick transport mechanism to the outlet point;

a second motor for driving the presenter transport mechanism, the second motor including a stepper motor;

a first pulse generator associated with the stepper motor for supplying pulses thereto at a rate which determines the speed of operation of the stepper motor;

a second pulse generator coupled to the first motor to generate pulses at a rate proportional to the speed of rotation of the first motor; and a selector device for selecting output pulses of either the first pulse generator or the second pulse generator to control the stepper motor such that the speed of the stepper motor can be synchronized with the speed of the first motor despite speed fluctuations of the first motor.

2. An apparatus according to claim 1, wherein the second pulse generator comprises (i) an optical disc coupled to rotate with the first motor and (ii) an optical sensor positioned close to the optical disc to generate pulses as the optical disc rotates.

3. An apparatus according to claim 1, wherein the pick transport mechanism and the presenter transport mechanism each include a respective conveyor belt system for carrying sheets picked from the stacks, the conveyor belt systems being separated from each other by a gap narrow enough to allow picked sheets to pass from the conveyor belt system of the pick transport mechanism to the conveyor belt system of the presenter transport mechanism.

4. An apparatus according to claim 3, wherein the selector device selects the output pulses of the second pulse generator when picked sheets are passing from the conveyor belt system of the pick transport mechanism to the conveyor belt system of the presenter transport mechanism.

5. An apparatus according to claim 1, further comprising (i) sheet holding means for temporarily holding in a stack the sheets that pass along the presenter transport mechanism, and (ii) means for passing the stack of sheets in the sheet holding means back to the presenter transport mechanism for transfer to the outlet point.

6. An automated teller machine (ATM) comprising:

at least one currency cassette for containing a stack of currency notes;

a pick mechanism associated with each currency cassette for picking currency notes from the currency cassette;

a pick transport mechanism for carrying currency note away from the picker mechanism;

a first motor for operating the picker mechanism and the pick transport mechanism;

a presenter transport mechanism for currency notes from the pick transport mechanism to an outlet point;

a second motor for driving the presenter transport mechanism, the second motor including a stepper motor;

a first pulse generator associated with the stepper motor for supplying pulses thereto at a rate which determines the speed of operation of the stepper motor; a second pulse generator coupled to the first motor to generate pulses at a rate proportional to the speed of rotation of the first motor; and a selector device for selecting output pulses of either the first pulse generator or the second pulse generator to control the stepper motor such that the speed of the stepper motor can be synchronized with the speed of the first motor despite speed fluctuations of the first motor.

7. An ATM according to claim 6, wherein the second pulse generator comprises (i) an optical disc coupled to rotate with the first motor and (ii) an optical sensor positioned close to the optical disc to generate pulses as the optical disc rotates.

8. An ATM according to claim 6, wherein the pick transport mechanism and the presenter transport mechanism each include a respective conveyor belt system for carrying sheets picked from the stacks, the conveyor belt systems being separated from each other by a gap narrow enough to allow picked sheets to pass from the conveyor belt system of the pick transport mechanism to the conveyor belt system of the presenter transport mechanism.

9. An ATM according to claim 8, wherein the selector device selects the output pulses of the second pulse generator when picked sheets are passing from the conveyor belt system of the pick transport mechanism to the conveyor belt system of the presenter transport mechanism.

10. An ATM according to claim 6, further comprising (i) sheet holding means for temporarily holding in a stack the sheets that pass along the presenter transport mechanism, and (ii) means for passing the stack of sheets in the sheet holding means back to the presenter transport mechanism for transfer to the outlet point.

* * * * *

UNITED STATES PATENT AND TRADEMARK OFFICE

CERTIFICATE OF CORRECTION

PATENT NO. : 5,915,681

DATED : June 29, 1999

INVENTOR(S) : Douglas L. Milne

It is certified that error appears in the above-indentified patent and that said Letters Patent is hereby corrected as shown below:

On the title page, item [54], and column 1, should read --

"[54] SHEET HANDLING APPARATUS" should be --[54] SHEET HANDLING APPARATUS HAVING COMBINED STEPPER MOTOR AND INDUCTION MOTOR DRIVEN CONVEYOR BELT SYSTEMS--.

Column 5, line 26, delete "each" and insert --at least one--.

Column 5, line 32, after "for" insert "transporting".

Signed and Sealed this

Sixteenth Day of May, 2000

*Attest:*

Q. TODD DICKINSON

*Attesting Officer*

*Director of Patents and Trademarks*